United States Patent [19]

Pohto

[11] 4,017,375

[45] Apr. 12, 1977

[54] BIPOLAR ELECTRODE FOR AN ELECTROLYTIC CELL

[75] Inventor: Gerald R. Pohto, Mentor, Ohio

[73] Assignee: Diamond Shamrock Corporation, Cleveland, Ohio

[22] Filed: Dec. 15, 1975

[21] Appl. No.: 640,647

[52] U.S. Cl. ..... 204/255; 204/268

[51] Int. Cl.[2] ..... C25B 9/00

[58] Field of Search ..... 204/255, 256, 268, 290 R

[56] References Cited

UNITED STATES PATENTS

| | | | |
|---|---|---|---|
| 3,312,614 | 4/1967 | Schick | 204/255 X |
| 3,926,770 | 12/1975 | Hoekji | 204/268 X |
| 3,930,981 | 1/1976 | De Nora et al. | 204/256 |

*Primary Examiner*—C. F. Lefevour
*Attorney, Agent, or Firm*—Bruce M. Winchell

[57] ABSTRACT

Disclosed is a bipolar electrode for stacking with other identical bipolar electrodes to form a filter press electrolytic cell. The anode and cathode compartments are pans, each pressed from a single sheet of an appropriate metallic material and are assembled in back-to-back spaced relation leaving an air space between the two pans. The peripheral channels of the pans are filled with a castable rigidizing material to form solid peripheral edges for sealing engagement of the bipolar electrode by other identical bipolar electrodes. These electrodes may be sealingly clamped together in series with diaphragms or membranes sandwiched in between if desired to form a cell structure.

11 Claims, 5 Drawing Figures

BIPOLAR ELECTRODE FOR AN ELECTROLYTIC CELL

BACKGROUND OF THE INVENTION

The present invention relates generally to an electrolytic cell assembly made up of a series of bipolar electrodes with diaphragms or membranes sandwiched in between for the production of alkali metal hydroxides and halogens. More particularly the present disclosure relates to an improved bipolar electrode wherein the anode and cathode compartments are pans, each pressed from single sheets of solid metallic materials and assembled in back-to-back spaced relation by suitable electrically conducting means, leaving an air space between the pans. Peripheral channels of the pans are filled with rigidizing material so as to form a solid clamping surface by which to stack the electrodes into a filter press electrolytic cell.

Chlorine and caustic (sodium hydroxide) are essential and large volume commodities which are basic chemicals required in all industrial societies. They are produced almost entirely by electrolysis of aqueous solutions of alkali metal chlorides, with a major proportion of current production coming from the diaphragm type electrolytic cells. These cells have a honeycomb type arrangement of anodes and cathodes with brine (sodium chloride) starting material fed into the cell through the anode compartment. To minimize back-diffusion and migration through the hydraulically permeable diaphragm, the flow rate is always maintained in excess of the conversion rate so that resulting catholyte solution has unchanged alkali metal chloride present. This catholyte solution, containing sodium hydroxide, unchanged sodium chloride, and certain other impurities, must then be concentrated and purified to obtain a marketable sodium hydroxide commodity and a sodium chloride solution to be reused in the diaphragm electrolytic cell. This is a serious drawback since the costs of this concentration and purification process are rising rapidly.

With the advent of technological advances such as the dimensionally stable anode which permits ever narrowing gaps between the electrodes and the hydraulically impermeable membrane, other electrolytic cell structures are being considered. The geometry of the diaphragm cell structure makes it unrealistic to place a planar membrane between the electrodes, hence the filter press electrolytic cell structure has been proposed as an alternate electrolytic cell structure.

A filter press electrolytic cell is a cell consisting of several units in series, as in a filter press, in which each electrode, except the two end electrodes, acts as an anode on one side and a cathode on the other, and the space between these bipolar electrodes is divided into an anode and cathode compartments by a membrane. In a typical operation, alkali metal halide is fed into the anode compartment where halogen gas is generated at the anode. Alkali metal ions are selectively transported through the membrane into the cathode compartment, and combine with hydroxyl ions generated at the cathode by the electrolysis of water to form the alkali metal hydroxides. In this cell the resultant alkali metal hydroxide is sufficiently pure to be commercially marketable, thus eliminating an expensive salt recovery step of processing. Cells where the bipolar electrodes and the diaphragms or membranes are sandwiched into a filter press type construction may be electrically connected in series, with the anode of one connected with the cathode of an adjoining cell through a common structural member or partition. This arrangement is generally known as a bipolar configuration. A bipolar electrode is an electrode without direct metallic connection with the current supply, one face of which acts as an anode and the opposite face as a cathode when an electric current is passed through the cell.

While the bipolar configuration provides a certain economy for electrical connection of these electrodes in series there is a serious problem with the corrosion of cell components in contact with the anolyte. The anolyte normally contains highly corrosive concentrations of free halide, and the use of base metals such as iron to contain the solution have proven to be ineffective.

Proposals to overcome this problem include utilizing valve metals or alloys thereof to contain anolyte, either by fabricating an entire electrode from such a corrosion resistant material or by bonding a coating of valve metal onto a base metal within the anolyte compartment. The use of large quantities of expensive valve metals in commercial cell construction though has proven to be economically impractical. The coated base metals on the other hand are prone to disintegration by pealing off of the protective layer and have also proven ineffective. It would therefore be very advantageous to provide a bipolar electrode wherein corrosion resistant valve metals are used in an economical manner to contain the anolyte, making a filter press electrolytic cell structure a viable commercial alternative for the present diaphragm cell.

SUMMARY OF THE INVENTION

It is therefore an object of the present invention to provide a bipolar electrode which is capable of insertion into a filter press electrolytic cell that will have a greatly simplified structure and contain the anolyte in a corrosion resistant compartment of the electrode.

It is another object of the present invention to provide an improved bipolar electrode wherein the anode and cathode pans may be pressed from solid thin sheets of appropriate metallic material using the same die molds.

It is a further object of the present invention to provide an improved unitized bipolar electrode which when connected in series with others of identical nature will achieve a good current efficiency.

These and other objects of the present invention, together with the advantages thereof over existing and prior art forms which will become apparent to those skilled in the art from the detailed disclosure of the present invention as set forth hereinbelow, are accomplished by the improvements herein shown, described and claimed.

It has been found that a bipolar electrode can be assembled from two pans of identical configurations joined in back-to-back spaced relation providing electrical contact therebetween, having an electrode plate connected to each pan such that the pans separate the electrode plates, having a peripheral channel which is filled with castable rigidizing material to provide a solid perimeter, and at least one access port in each compartment for adding materials or removing products from the bipolar electrode.

The preferred embodiments of the improved bipolar electrode are shown by way of example in the accompanying drawings without attempting to show all of the various forms and modifications in which the invention might be embodied; the invention being measured by the appended claims and not by the details of the specification.

DESCRIPTION OF THE PREFERRED EMBODIMENTS

Figure 1:
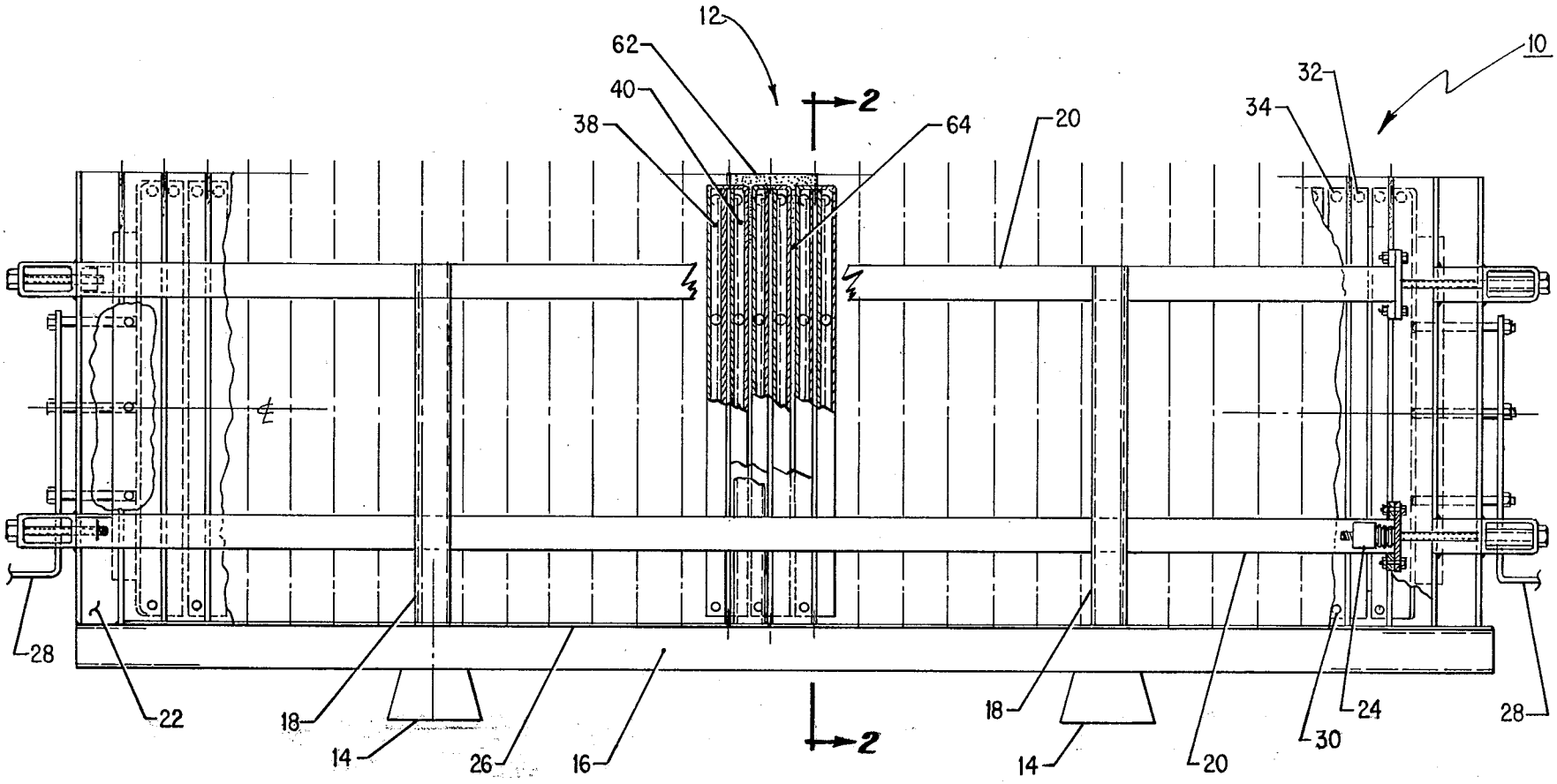
FIG. 1 is a side elevation view of a filter press electrolytic cell with partial section views of various segments of the cells showing the placement of the bipolar electrodes therein according to the concepts of the present invention.

Referring to the drawings FIG. 1 shows a filter press electrolytic cell 10 and employing a bipolar electrode 12 according to the concepts of the present invention. The filter press electrolytic cell 10 pictured in FIG. 1 can be used for the production of halogens and alkali metal hydroxides as hereinabove described. This cell 10 can be made of any size appropriate to handle various numbers of bipolar electrode 12 as may suit production needs for halogens and alkali metal hydroxides. The preferred sizes for such a filter press electrolytic cell 10 are those which contain 31 bipolar electrodes 12 stacked together in series. The cell construction is supported by concrete pedestals 14 in a position slightly above the floor for easier access thereunder. The filter press electrolytic cell 10 has a base frame member 16 upon which uprights 18 are placed directly over the concrete pedestals 14 for support of cross members 20 holding the bipolar electrodes 12 in place. At one end of the base frame member 16 and the cross members 20 is a stationary end block 22 to support the bipolar electrodes 12 which are settled into the filter press electrolytic cell 10 in series. At the other end of the base frame member 16 and cross members 20 is a movable threaded block 24 which is used to support the electrodes 12 in liquid tight engagement with one another and stationary end block 22. Movable threaded block 24 may be retracted to allow convenient removal of any given bipolar electrode or for easy access to the interior of the cell 10. On top of the base frame member 16 and over other such metal parts as may be necessary, is a sufficient layer of insulating material 26 to prevent the short circuiting of any of the bipolar electrodes 12 such that the current will be forced through the electrodes 12 in series from one end of the cell 10 to the other end of the cell 10. At each end of the cell 10 are electrical bus bars 28 which provide current to either side of the cell 10 so as to complete an electrical circuit through all of the bipolar electrodes 12 stacked in series. As might be anticipated by those skilled in the art the subject cell 10 can be modified in numerous ways to suit a particular production purpose.

Looking more closely at the individual bipolar electrode 12 as shown in FIG. 1, each bipolar electrode 12 has access ports to permit fluid communication with each compartment or closed space within each bipolar electrode 12 when assembled into the cell 10. At the bottom thereof is an input feed tube 30 for the input of reactants for a given reaction, such as brine in the case of chlorine and caustic cell. At the top of each bipolar electrode 12 is an anode compartment access 32 for the removal of chlorine gas and depleted brine in the case of a chlorine and caustic cell, and a cathode compartment access 34 for the removal of sodium hydroxide and hydrogen gas. The peripheral dimensions and shape of the bipolar electrode 12 are not critical and can be adjusted to suit the particular cell design and output desired. The height and width generally range from 2 to 8 feet, while the thickness of the individual bipolar electrodes 12 may vary from 2 to 8 inches. A membrane 36 separates adjacent bipolar electrodes 12 to provide an anode compartment 38 and a cathode compartment 40. A planar diaphragm could also be used where hydraulic permeability is desired. Between each bipolar electrode 12 and the membrane 36 is gasketing 42. Gasketing 42 serves the purpose of effecting a seal between the bipolar electrodes 12 and also as a spacing device between the bipolar electrodes 12 and the membrane 36. Any gasketing material must of course be resistant to the electrolytes used within the cell 10, thus polymeric or hard rubber compositions are examples of suitable materials.

The bipolar electrode 12 consists of an anode pan 44 and a cathode pan 46 which are joined together in back-to-back spaced relation by any suitable bonding technique for electrically and mechanically connecting pans 44 and 46. Each of these pans 44 and 46 may have any configuration, shape or dimensions so long as they are identically corresponding such that they may join back-to-back to present mirror images, one of the other. Each pan 44 or 46 will generally have a depressed area 48 in the central portion of each pan to form the anode compartment 38 and the cathode comartment 40. Each pan 44 and 46 will also have a rim 50 completely around the peripheral edge of each pan so as to present a raised portion of each pan 44 and 46, and a sidewall 52 on each pan between the rim 50 and the depressed area 48. The rim 50 as can be seen in FIGS. 2, 3, 4 and 5 presents a flat surface area 54 which is used to seal each of the bipolar electrodes 12 one to another in liquid tight engagement to form a filter press electrolytic cell such as that seen in FIG. 1.

This type of structure presents the advantage of being capable of single stroke formation in standard sheet metal fabrication stamping equipment. This permits the use of rather thin sheets of solid materials for the fabrication of cell pans 44 and 46. The thicknesses of these pans will generally run from 0.010 to 0.25 inch with the preferred thickness being 0.040 – 0.080 inch. This will greatly conserve the use of expensive metallic materials while avoiding the drawbacks of bonded materials. It has also been found that pans of various metallic materials can all be pressed from the same set of die molds therefore presenting a decided economy in the manufacture of various anode and cathode pans 44 and 46. The anode pan 44 for instance might be made of titanium and the cathode pan 46 of nickel. It has been found for example that nickel and titanium pans can very easily be formed in the same set of die molds thereby assuring uniformity at a low cost. The uniformity of pans 44 and 46 is important to effect a good liquid tight seal between the bipolar electrodes 12 when stacked in the electrolytic cell 10.

Figure 4:
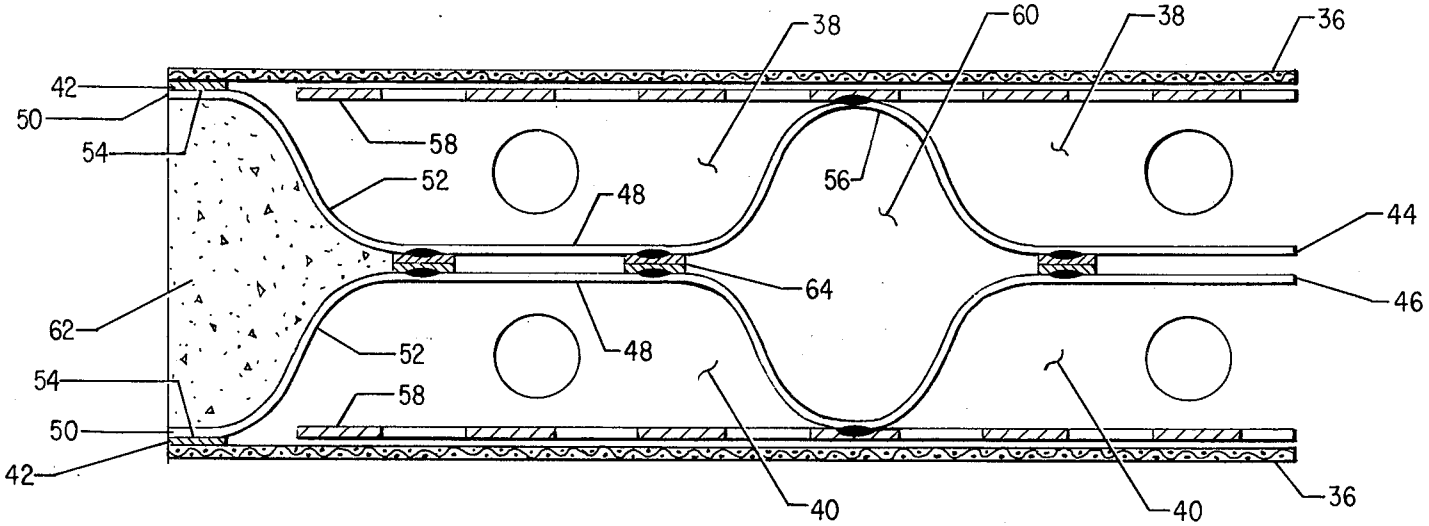
FIG. 4 is a partial side section view of a second embodiment of the bipolar electrode which in relation to the first embodiment corresponds to FIG. 3 hereinabove described.

In the second embodiment pictured in the FIG. 4 one can see that if rigidizing is desired for the particular pan to strengthen a thin gauge steel or other metallic substance, one can easily form extra ridges 56 in the central portion of the pans to provide extra structural integrity to the pan 44 or 46 and also a more convenient place for spot welding of an electrode plate 58 to the pan 44 or 46. When pans 44 and 46 are placed back-to-back the ridges 56 will form an open space 60 between the pans 44 and 46 which can be filled with a castable rigidizing material if further strengthening is necessary or desired. Also these ridges 56 might be in the form of conical risers, thereby presenting less restriction to fluid movement within the anode compartment 38 and cathode compartment 40.

When pans 44 and 46 are placed in back-to-back spaced relation to form the unitized bipolar electrode 12, around the peripheral edge of the two pans will be a peripheral channel 62. This channel 62 can then be filled with a castable rigidizing material to form a solid backup for the pans 44 and 46 such that when the pans are joined together in series to form an electrolytic cell 10 there will be a solid clamping surface upon which to sealingly engage the bipolar electrodes 12 in series to form the electrolytic cell 10. Alternatively, other types of closure devices may be used such as clips, bolting or riveting. An air space is left between the two pans 44 and 46 so that hydrogen ions eminating from the cathode plate 58 of the cell 10 will migrate into this air space and combine to form molecular hydrogen which is then vented to the atmosphere. This prevents hydrogen ions from reaching the titanium anode pan 46 which is subject to hydrogen ion permeation which in turn could result in hydride embrittlement of the anode pan 46.

Figure 3:
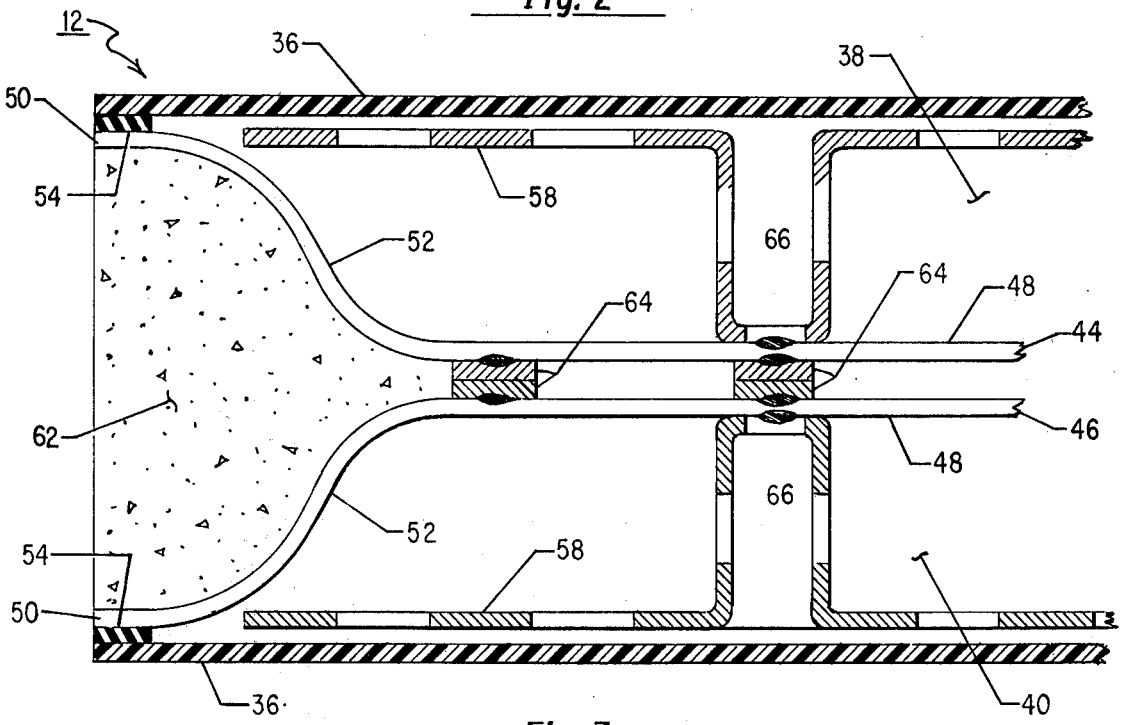
FIG. 3 is a partial side section view of the bipolar electrode taken substantially along line 3—3 of FIG. 2.

Since electrical contact between the two pans is essential for the basic function of the bipolar electrode 12 according to the concepts of the invention, various means of effecting the electrical and mechanical connection between the two pans have been found suitable. As seen in FIG. 3 and 4, a bimetal strip 64 connects the two pans 44 and 46 mechanically and electrically by a weldment affected between each of the pans 44 and 46 and the bimetal strip 64. If for instance the anode pan 46 is made of titanium and the cathode pan 44 is made of nickel then the bimetal strip 64 would have a nickel side facing the cathode pan 44 and a titanium side facing the anode pan 46 such that conventional resistance welding will accomplish a solid electrical and mechanical connection between the two pans 44 and 46. A suitable bimetal strip 64 material commercially available in the form of sheets, have thicknesses of 0.030 to 0.250 inch with the preferred thickness being in the range of 0.040 to 0.080 inch. An internal bolting system could be used where the electrode is bolted through one pan, providing a spaced relation by use of a spacer, and through the second pan to the other electrode. This requires precise placement of holes in each pan and good sealing techniques to insure a liquid tight connection. A third method utilizes an explosion bonding technique where a solid piece of copper strip or other electrically conductive metallic material is explosion bonded to each pan. Such techniques are described in further detail in the following patent which is hereby incorporated by reference: U.S. Pat. No. 3,137,937. Other techniques include silver brazing, riveting, and a button and cap arrangement where a stud is pressed through both pans and a cap is placed over the button.

Figure 2:
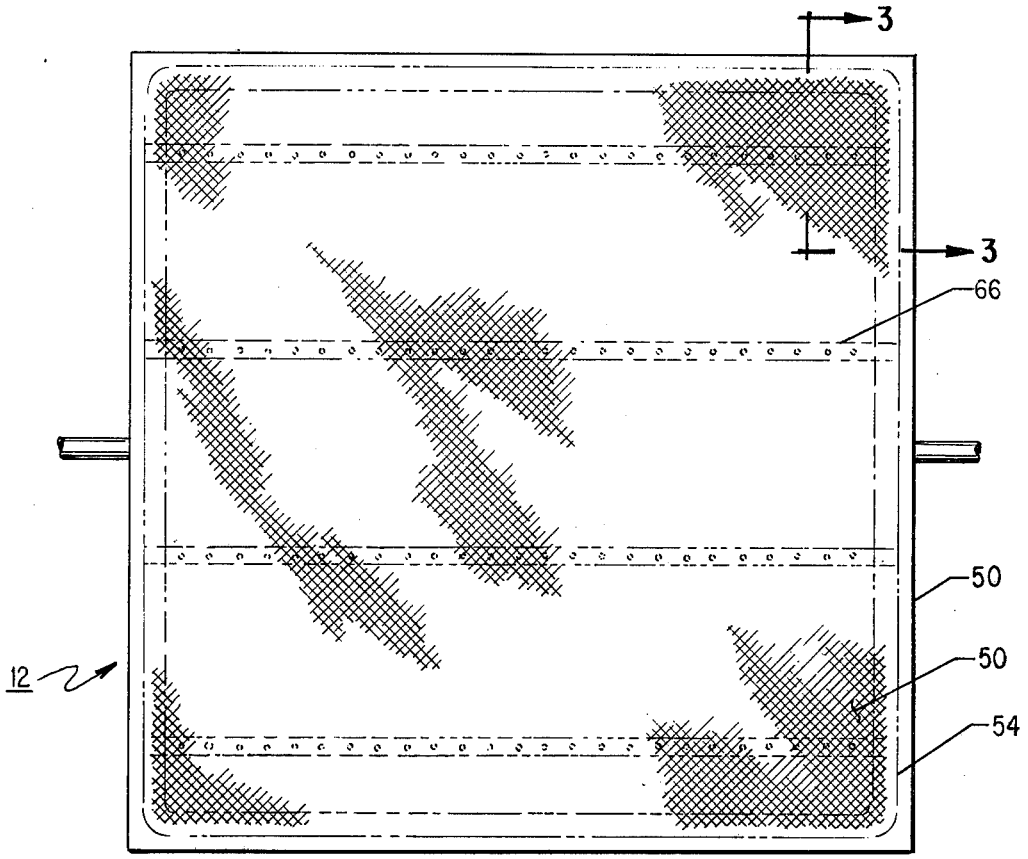
FIG. 2 is a front elevation view of the first embodiment of the bipolar electrode taken substantially along line 2—2 of FIG. 1.

It can be appreciated that various materials commercially available can be used for electrode plates 58 in the construction of cathodes and anodes according to a particular type of reaction to be performed. These materials will generally be foraminous in nature. FIG. 2 illustrates a foraminous electrode plate 58 which is made of a mesh and its placement on a bipolar electrode 12 according to the concepts of the present invention. FIGS. 3 and 4 show the side views of the electrode plates 58 attached to the pans and the different configurations of the electrode plates 58 necessary to make contact between the pans 44 and 46 and the electrode plates 58 possible at various points along the pans 44 or 46. For example the anode plate 58 might be made of titanium mesh to match the anode pan 46 which is also made of titanium and the cathode plate 58 might be made of nickel mesh to match the cathode pan 44 made of nickel. Those skilled in the art will realize that various electrocatalytically active coatings may be used over the titanium substrate of anode plate 58 to enhance its life. The electrode plates 58 as seen in FIG. 2 are cut slightly smaller than pan 44 or 46, so that mechanical and electrical contact will be effected in the central portion of the pan. There is no reason, though, why the electrode plates 58 could not just be welded around their perimeter to the perimeter of the respective pans 44 or 46 so long as sufficient current flow could be carried thereby. The electrode plates 58 will generally be coplanar with the flat surface area 54 of the pan 44 or 46 so that gasketing 42 willdetermine the gap between the electrode plates 58 and the membrane 36. In FIG. 3 the electrode plate 58 has channels 66 which can be spot welded to the respective pans 44 or 46. In the second embodiment seen in FIG. 4 the ridges 56 were formed in the pans 44 and 46 high enough to provide a convenient spot welding point to a planar electrode plate 58, thus dispensing with the need to form channels 66 in electrode plates 58.

Figure 5:
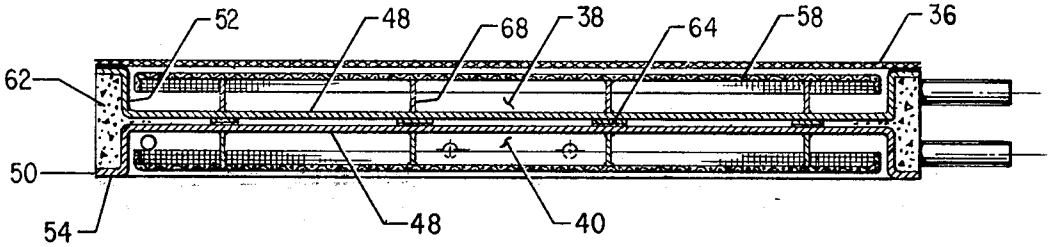
FIG. 5 is a side section view of a third embodiment of the bipolar electrode which in relation to the first embodiment corresponds to FIG. 3 hereinabove described.

FIG. 5 shows a third embodiment of the bipolar electrode 12. The major differences reside in the fact that the corners bordering the depressed area 48 and rim 50 are 90° angles, thus presenting a vertical sidewall 52. Also a planar electrode plate 58 is attached to the pans 44 and 46 by means of a series of posts 68. These posts are generally made of the same material as the electrode plate 58 and the pan 44 or 46 so that they may be spot welded in place.

During a typical operation of the filter press electrolytic cell 10 utilizing a series of unitized bipolar electrodes 12 according to the concepts of the present invention for an electrolysis of, for example, an aqueous sodium chloride solution, brine having a sodium chloride concentration of approximtely 120 to 310 grams per liter is introduced into the anode compartment 38 of the bipolar electrode 12, while water or recirculating sodium hydroxide solution of approximately 25 to 43 percent is introduced into the cathode compartment 40. As the electrolyzing direct current is impressed on the cell from a suitable power source, chlorine gas is evolved at the anode. The evolved chlorine is completely retained within the anode compartment 38 until it is removed from the cell along with the depleted brine solution through the anode compartment access 32. Sodium ions formed in the anode compartment 38 selectively migrate through the membrane 36 into the cathode compartment 40, where they combine with hydroxyl ions formed at the cathode. Sodium hydroxide and hydrogen gas thus formed are removed from the cell through the cathode compartment access 34. Non-critical process parameters including operating temperatures within the range of 25° and 100° centigrade, a brine feed pH of 1 to 6, and current densities through the filter press electrolytic cell 10 on the order 1 to 5 amp per square inch of electrode plate 58 surface area.

Electrolytic cells employing the unitized bipolar electrode 12 will find application in other electrochemical processes such as for the production of various organic compounds, hypochlorate and chlorates.

In operation, the bipolar electrode 12 may be disposed either horizontally or vertically as seen in FIG. 1; however, a more or less vertical orientation is preferred since the introduction of brine at the cell bottom and removal of gaseous products from the top are thereby facilitated.

Thus it should be apparent from the foregoing description of the preferred embodiments, that the device herein shown and described accomplishes the objects of the invention and solves the problems attendant to such devices.

What is claimed is:

1. A bipolar electrode comprising: two pans of identical configurations; an electrode plate connected to each of said pans such that said pans separate said electrode plates; means for connecting said pans in back-to-back spaced relation to provide electrical and mechanical contact therebetween; said pans presenting a peripheral channel when connected; and at least one access port for adding materials or removing products from the bipolar electrode.

2. A bipolar electrode according to claim 1 wherein said peripheral channel is filled with castable rigidizing material to provide a solid perimeter.

3. A bipolar electrode according to claim 1 wherein said pans have at least one ridge through the central portion of said pans.

4. A bipolar electrode according to claim 1 wherein said electrode plates have channels therein which provide a means for connecting said electrode plates to said pans.

5. A bipolar electrode according to claim 1 wherein said pans are formed in the same die molds.

6. A bipolar electrode according to claim 1 wherein said pans are made of solid metallic materials chemically resistant to the respective electrolytes.

7. A bipolar electrode according to claim 1 wherein said means for connecting said pans is internal bolting.

8. A bipolar electrode according to claim 1 wherein said pans are made of two different metallic substances.

9. A filter press electrolytic cell comprising: a base frame; a stationary end block connected to one end of said base frame; a movable block connected to the other end of said base frame capable of applying a clamping force in coordination with said stationary end block; a plurality of bipolar electrodes stacked in between said stationary end block and said threaded end block in sealing engagement; said bipolar electrodes having two pans of identical configurations joined in back-to-back spaced relation, an electrode plate connected to each of the pans, castable rigidizing material filling a peripheral channel to provide a solid perimeter, and at least one access port for adding and removing substances from within the electrolytic cell compartments; and means for applying an electrolyzing current to said bipolar electrodes in series.

10. A filter press electrolytic cell according to claim 9 further comprising a hydraulically impermeable membrane separating each of said bipolar electrodes.

11. A filter press electrolytic cell according to claim 10 further comprising a means for providing a precise gap between each of said bipolar electrodes and each of said membranes in fluid tight engagement thereto.

* * * * *